United States Patent [19]

Ritter et al.

[11] Patent Number: 4,543,045

[45] Date of Patent: Sep. 24, 1985

[54] FUEL INJECTION PUMP FOR INTERNAL COMBUSTION ENGINES

[75] Inventors: Ernst Ritter, Stuttgart; Reinhard Schwartz, Stuttgart-Sillenbuch; Johann Warga, Bietigheim-Bissingen, all of Fed. Rep. of Germany

[73] Assignee: Robert Bosch GmbH, Stuttgart, Fed. Rep. of Germany

[21] Appl. No.: 616,447

[22] Filed: Jun. 1, 1984

[30] Foreign Application Priority Data

Jul. 20, 1983 [DE] Fed. Rep. of Germany ..... 3326045

[51] Int. Cl.[4] ..... F02M 59/26; F02M 59/44

[52] U.S. Cl. ..... 417/499; 417/490

[58] Field of Search ..... 417/490, 494, 499, 539; 123/495, 500, 501, 503, 509, 514

[56] References Cited

U.S. PATENT DOCUMENTS

| | | | |
|---|---|---|---|
| 2,463,374 | 3/1949 | Garday | 417/494 |
| 3,759,637 | 9/1973 | Vuaille | 417/499 |
| 4,118,156 | 10/1978 | Ivosevic | 417/494 |
| 4,222,717 | 9/1980 | Clouse et al. | 123/503 |

FOREIGN PATENT DOCUMENTS

| | | | |
|---|---|---|---|
| 213145 | 1/1961 | Austria | 417/494 |
| 227851 | 10/1943 | Switzerland | 417/494 |
| 1281308 | 7/1972 | United Kingdom . | |

*Primary Examiner*—Leonard E. Smith

*Attorney, Agent, or Firm*—Edwin E. Greigg

[57] ABSTRACT

Each of the pump cylinders disposed in a line, of the fuel injection pump is surrounded in the vicinity of an overflow opening controlled by control edges of the pump piston by a partial suction chamber embodied as a hollow space. Each of these partial suction chambers is supplied with fuel, beginning at an inflow conduit via a throttled inflow opening and the fuel is carried away again via a return-flow opening into a return-flow conduit common to all the pump cylinders. Because of the crosswise flushing of each individual partial suction chamber the fuel temperature in these partial suction chambers is kept at least virtually constant, in order that identical fuel quantities will be supplied to the individual pump cylinders.

20 Claims, 5 Drawing Figures

FUEL INJECTION PUMP FOR INTERNAL COMBUSTION ENGINES

BACKGROUND OF THE INVENTION

The invention relates to a fuel injection pump for internal combustion engines as described hereinafter. Injection pumps having pump cylinders disposed in series, also known as series injection pumps, have been manufactured on a very large scale all over the world for decades and have heretofore quite satisfactorily attained the required accuracy in fuel quantity metering. However, with the greatly elevated injection pressures needed to apply modern injection methods to Diesel engines, and the ever-more stringent exhaust emission regulations and the resultant increasingly stringent requirements for accuracy in fuel metering on the part of the individual pump elements, it has proved to be disadvantageous that the pump elements connected to a common suction chamber furnish varying injection quantities, especially during full-load engine operation, unless at least a partial correction is made by means of an expensive, iterative adjustment process which preferably should be avoided. These deviations in fuel quantity arise because between the inlet and the outlet of the fuel inside the pump housing, partial heating of the fuel takes place, due particularly to the quantities of fuel that are diverted at high pressure at the end of fuel supply. Because of the different temperatures and the altered density and compressibility of the fuel, this causes corresponding deviations in fuel supply quantities per stroke of the pump piston, and hence causes the output of the various engine cylinders to differ from one another.

In a fuel injection pump of the same generic type, known from German Offenlegungsschrift No. 25 47 071, the common suction chamber that had been known until then was subdivided into a plurality of partial suction chambers, one being associated with each pump cylinder, and each being supplied separately with fuel via an inlet conduit that was separate from the return-flow conduit. Since the respective inlet element to the partial suction chambers is molded in the housing by casting and is very large in size, and since the throughput through the partial suction chambers is metered by respective throttled return-flow cross sections, it is unavoidable in this design that the discharge fuel, which emerges at high pressure and is heated up to a corresponding extent, will mix with the fresh, incoming fuel, thus causing uncontrollable heating and mixing in the inlet conduit despite the provision of separate partial suction chambers.

OBJECT AND SUMMARY OF THE INVENTION

It is accordingly the principal object of the invention to overcome these disadvantages, to prevent the diverted fuel at least for the most part from returning to the inlet conduit and to embody the throughout through the individual partial suction chambers such that a uniform flushing of the partial suction chambers and a discharge of the heated fuel into the return flow conduit are assured in every operating state.

The fuel injection pump according to the invention and having the characteristics disclosed herein has the advantage over the prior art that each of the partial suction chambers completely surrounding the pump cylinder communicates only via a relatively narrow inlet opening and a discharge opening with the corresponding inlet and return flow conduits, while the throttled inlet opening for the most part prevents a backflow of the diverted fuel into the inlet line and meters and controls the throughput through the partial suction chambers embodied as hollow spaces.

By means of the provisions narrated hereinafter advantageous further embodiments of and improvements in the fuel injection pump defined are attainable.

In a further feature of the invention an unhindered discharge to the return-flow conduit is fixed such that it occurs automatically. By means of the matching of the flowthrough cross sections of the inlet openings defined later the flowthrough cross sections of each successive inlet opening are enlarged as compared with the immediately previous inlet openings in stages that are easily defined by trial and error, the enlargement taking place from the direction of the inlet of the inlet conduit, in order to equalize the flow resistance and to assure a uniform fuel flow through each of the partial suction chambers. Fabrication at a favorable cost is attained by the embodiment of the return-flow and inflow conduits as longitudinal bores through the pump housing as also recited and by means of the partial suction chambers which are embodied by a section of the reception bores. Because of the inclined, oblique position of the connecting bores embodying the return-flow and inlet openings as defined the flow of the fuel flowing through the partial suction chambers is deflected appropriately for good mixing of the fuel in the partial suction chambers, and the fabrication of these bores, from the direction of the mounting side of the pump elements, through the corresponding reception bores is facilitated. The connecting bores may be realized as tapholes drilled from the inside through to the conduits, so that no stopper plugs to be inserted into the housing in a pressure-tight manner are required, as would be the case with horizontally drilled connecting bores and as is the case in the embodiment of the known fuel injection pump.

If a slightly increased expense is acceptable, then with the characteristics further disclosed herein a partial return flow of the discharging fuel into the inlet conduit can be reliably prevented by building the check valves into the inlet openings. A favorable solution in terms of the space required as well as of cost is attained with the structure of the check valves being arranged in a manner revealed herein.

In a variant embodiment disclosed herein the fuel injection pump according to the invention has the sheet-metal inserts inserted into the segments of the reception bores bordering on the partial suction chambers include both the return-flow and the inflow openings, so that corresponding conduits for receiving these openings may be dispensed with, and the fuel injection pump can have a correspondingly narrower pump housing with the return-flow and inflow conduits disposed closer together. Fabrication of the sheet-metal inserts at a favorable cost is attained by the provisions disclosed later herein where no additional securing parts are required for securing the rotational position, which affords a further advantage. If the sheet-metal insert is made of hardened steel then it serves at the same time as an impact protection ring to protect the pump housing from erosion resulting from the energy of the fuel emerging from the overflow opening at the end of injection. Thus specialized components that provide impact protection may be dispensed with, or else in the case of very highly stressed injection pumps the protection of the housing is increased.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
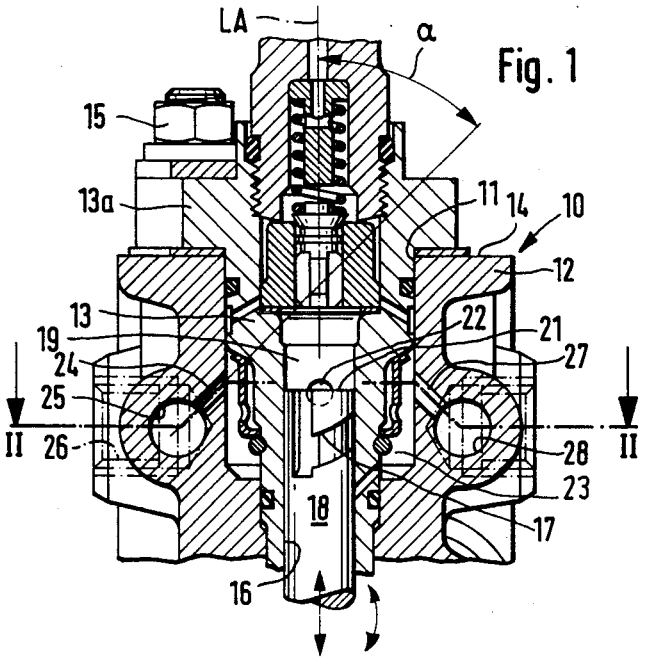
FIG. 1 is a fragmentary cross section through the first exemplary embodiment of a fuel injection pump equipped according to the invention, the section taken along the line I—I of FIG. 2.

In the first exemplary embodiment, shown in FIG. 1, of a fuel injection pump for Diesel engines realized as a four-cylinder in-line injection pump, a pump cylinder 13, provided with a fastening flange 13*a*, is inserted into a reception bore 11 of a pump housing 12 from the direction of a top 14 of the pump, as shown by the cross-sectional view in FIG. 1 taken through a pumping element and illustrating the essential characteristics of the invention, and is secured in the pump housing 12 by fastening screws 15. Each of the pump cylinders 13, disposed in a line in accordance with the reception bores 11 disposed in a line in FIG. 2, receives a pump piston 18, having a control edge 17 controlling the end of injection, in a cylinder bore 16. The pump piston 18 is guided in the cylinder bore 16 such that it is axially and rotationally movable and with its end face oriented toward a pump work chamber 19 it forms a second control edge 21 determining the onset of supply.

In the wall of the pump cylinder 13 there is a discharge opening 22 controlled by the control edges 17 and 21 of the pump piston 18 and in the present example these serve at the same time as an intake opening, from which the fuel flows back into a partial suction chamber 23 at high pressure at the end of injection. Each of the partial suction chambers 23 is embodied as a hollow space entirely surrounding the pump cylinder 13 in the vicinity of the discharge opening 22. The partial section chambers 23 are each defined by a respective section 11*a* of the reception bores 11 machined into the pump housing 12 from the pump top 14 and are each connected, via a respective throttled inlet opening 24, with an inlet conduit 25 extending in the longitudinal direction of the pump housing 12; they are supplied with fresh fuel flowing in via a respective inlet bore 26, and via return-flow openings 27, they are connected to a separate return-flow conduit 28 disposed parallel to the inlet conduit 25 in the longitudinal direction of the pump housing 12.

Each return-flow opening 27 has a flowthrough cross section $A_R$ which is substantially smaller than the cross section of the return flow conduit 28, and the flowthrough cross section $A_Z$ of each throttled inlet opening 24 is smaller than the flowthrough cross section $A_R$ of the associated return-flow opening 27.

Figure 2:
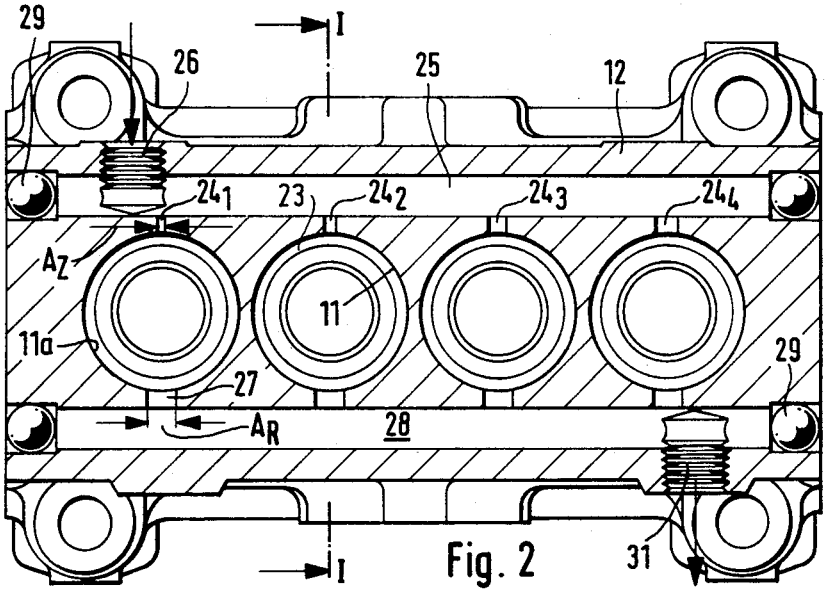
FIG. 2 is a horizontal section taken along the line II—II of FIG. 1, rotated by 90°, through the pump housing embodied accordingly; that is, the drawing shows the pump housing with the pumping elements removed, for the sake of better comprehension.

In order to compensate the flow resistance and to assure a uniform fuel flow through each of the partial suction chambers 23, the flowthrough cross sections $A_Z$ of the inlet openings 24 are adapted such that—viewed from the inlet, formed by the inlet bore 26, of the inlet conduit 25—the flowthrough cross section $A_Z$ of the next inlet opening 24 in succession is designed to be larger, by an empirically ascertainable value, that the corresponding cross section of the preceding inlet opening 24. To illustrate this graduation, the inlet openings 24 of the partial suction chambers 23 disposed in line are provided in FIG. 2 with subscript numerals 1-4. As seen in FIG. 2, the diameter and thus the inlet cross section $A_Z$ of the opening $24_2$ is larger than the cross section of the opening $24_1$. The same is true of the other openings $24_3$ and $24_4$ in corresponding fashion. The return-flow openings 27 preferably have a flowthrough cross section $A_R$ that is also markedly larger than the cross section of the opening $24_4$.

In a practical application in a fuel injection pump, size P, made by Robert Bosch GmbH in Stuttgart, Federal Republic of Germany, diameters from 1.5 to 1.9 mm were selected for the diameters of the inlet openings $24_1$–$24_4$, while the return-flow openings 27 all had the same diameter of 3.4 mm.

The inlet and discharge conduits 25, 28 embodied by longitudinal bores drilled parallel to one another through the pump housing 12 are closed at their respective ends by ball means 29 pressed into them.

As shown by FIG. 1, the return-flow openings 27 and inlet openings 24 are embodied as connecting bores beginning at the partial suction chambers 23 and discharging directly into the return-flow conduit 28 and inlet conduit 25, respectively. These connecting bores have an oblique position inclined with respect to the pump top 14 and forming an acute angle with the longitudinal axis LA of the pump cylinder 13 or pump piston 18.

A flow through the pump housing 12 such as to generate relatively little turbulence, or "dead-water zones", is also enabled by the provision that the inlet bore 26, forming the inlet, of the inlet conduit 25 discharges at the left end of this inlet conduit, as seen in FIG. 2, and a corresponding outlet, formed by an outlet bore 31, leads away from the right end of the return-flow conduit 28.

In order to attain a substantially uniformly aligned flow through the partial suction chambers 23, it would also be possible to provide that the inlet openings 24 and return-flow openings 27 discharge into or emerge from the partial suction chambers 23 at least approximately at a tangent (not shown).

Figure 3:
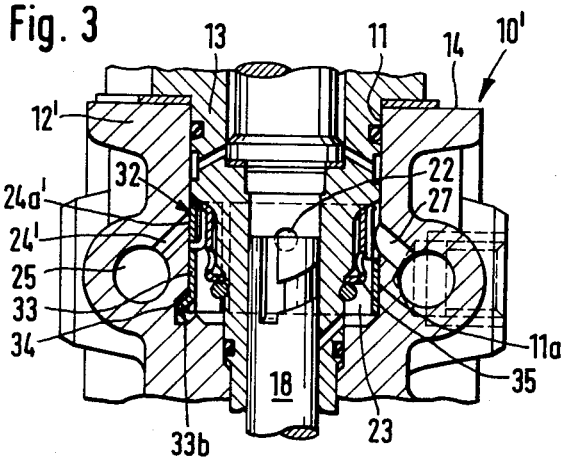
FIG. 3 is a sectional view similar to FIG. 1, but for the second exemplary embodiment.

In the second exemplary embodiment, shown in a fragmentary cross section in FIG. 3, the fuel injection pump 10' differs only in that a check valve 32 is additionally disposed therein. Elements identical to those of FIGS. 1 and 2 are therefore identified by identical reference numerals, while elements differing slightly are provided with a prime.

Figure 4:
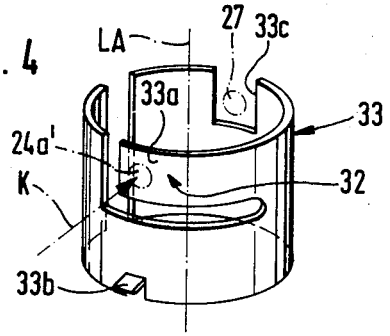
FIG. 4 is a perspective view of the sheath, rolled from spring steel and having a tongue-like valve member for the check valve associated with each partial suction chamber, which is used in the second exemplary embodiment.

Each of the inlet openings 24', which here are offset slightly with respect to the pump top 14 and discharge into the partial suction chambers 23, is provided with the check valve 23 opening toward the partial suction chamber 23. This check valve 32 is embodied as a so-called "flutter valve", the movable valve member 33*a* of which is formed by a tongue-like section of a slotted sheath 33 rolled from spring steel (see FIG. 4). This valve member 33 rests with a slight initial tension on an orifice 24*a'*, serving as the valve seat, of the associated inlet opening 24' in a positively engaged manner. This orifice 24*a'* is indicated by dot-dash lines in the perspective view of the sheath 33 shown in FIG. 4, and the valve member 33*a* formed by the tongue-like section is shown in the opening position, in which the fuel flowing in via the inlet opening 24' (see arrow K) has pressed the valve member 33*a* inward, that is, in the direction toward the longitudinal axis LA. In the position of rest of the valve member 33*a*, this member rests in a positively engaged manner on the orifice 24*a'*, as shown in FIG. 3. The initial tension which is required, although it is slight, is generated by means of a corresponding initial position of the valve member 33*a*, in which it is bent outward (not shown). The height at which the sheath 33 rolled from spring steel is mounted is fixed such that over the entire height it fills up the cylindrical wall of the section 11*a* of the reception bore 11 that forms the partial suction chamber 23. Before the pump cylinder 13 is installed, this sheath 33 is inserted into the section 11*a* and then, because of an initial tension imparted by the rolling operation, it rests positively on this wall. To positionally secure the sheath 33, this element is provided with a convex protrusion 33*b*, which engages a recess 34 (see FIG. 3) machined into the wall of the section 11*a*. This positional securing is not only responsible for the position of the movable valve member 32*a* before the orifice 24*a'*, but also assures that a recess 33*c* machined into the sheath 33 does not cover the return-flow opening 27 shown in dot-dash lines in FIG. 4. An impact sheath 35 known per se and encompassing the pump cylinder 13 in the area of the discharge opening 22 serves in a known manner to protect the pump housing 12' from destruction by the energy of the fuel emerging abruptly from the discharge opening 22 at the end of injection. In the present exemplary embodiment, this impact sheath 35 also serves to protect the check valve 32, in particular from its valve member 33*a* located on the sheath 33.

Figure 5:
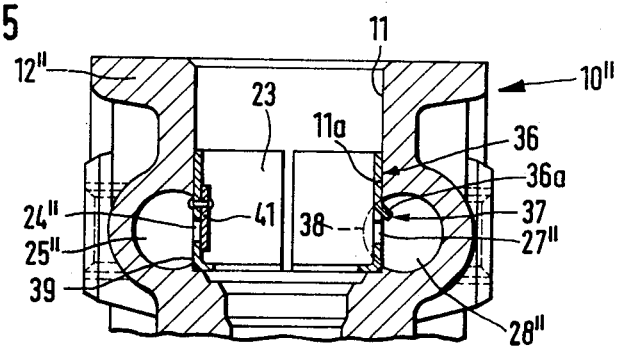
FIG. 5 is a cross section taken through the partial suction chamber in the pump housing of the third exemplary embodiment, with the pumping element removed.

In the third exemplary embodiment shown in a fragmentary cross section in FIG. 5, the fuel injection pump 10'' differs from the exemplary embodiments described above substantially in that it has a sheet-metal insert 36 inserted into each of the sections 11*a* of the reception bores 11 defining the partial suction chambers 23, and in its wall this sheet-metal insert 36 includes both the return-flow opening 27'' and the throttled inlet opening 24'', disposed diametrically opposite one another. The sheet-metal insert 36 comprises a slotted sheath rolled from sheet steel, the rotational position of which is fixed by a securing element 37.

Serving as the securing element 37 is a protrusion 36*a* bent outward from the wall of the sheet-metal insert 36 and engaging a flowthrough opening 38 formed by an intersection of the return-flow conduit 28'' with the reception bore 11.

The material of the sheet-metal insert, once its manufacture is complete, is hardened steel, and it thus serves simultaneously as an impact protection ring for the fuel stream emerging with great energy at the end of supply from the discharge opening 22 of the pump cylinder 13. As a result, the impact protection ring 35 on the pumping element itself, shown at 35 in FIG. 3, may be dispensed with, or in the case of high-pressure injection pumps the sheet-metal insert can serve to provide additional protection for the pump housing, should the existing impact protection means be incapable of reducing the energy of the emerging fuel to such as extent that no further damage occurs. Prior to being mounted in the reception bore 11, the sheet-metal insert 36, which may preferably be fabricated from spring-steel bands, is made in an oversize such that after being mounted, it rests positively, being secured by its inherent spring action, on the wall of the section 11*a*, defining the partial suction chamber 23, of the reception bore 11.

Both longitudinal conduits in the pump housing 12'', that is, the return-flow conduit 28'' and the inlet conduit 25'', are drilled through the pump housing 12'' so close to the reception bores 11 that in addition to the flow-through openings 38 between the return-flow conduit 28'' and the reception bores 11, flowthrough openings 39 are also produced between the inlet conduit 25'' and the reception bores 11. These flowthrough openings 29 (FIG. 2) are closed, however, by the corresponding wall parts of the sheet-metal inserts 26, which include only the throttled inlet opening 24'' as the sole connection between the associated partial suction chamber 23 and the inlet conduit 25''.

With an appropriate embodiment of the throttled inlet opening 24'' and the return-flow opening 27'' of larger cross section, a permanent flow of fuel is directed through the partial suction chamber 23, and a return flow of heated fuel into the inlet conduit 25'' is predominantly precluded.

In order to preclude such a return flow entirely, the sheet-metal insert 36 may also be provided with a check valve 41, embodied as a tongue valve and opening toward the partial suction chamber 23, which is riveted to the sheet-metal insert 36. This valve 41 is shown in FIG. 5 and functions in the same manner as the check valve 32 described in conjunction with FIGS. 3 and 4 and shown therein.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising a plurality of pump cylinders disposed in line in reception bores of a pump housing having a top, each of said pump cylinders arranged to receive a pump piston provided with control edges to determine the duration of injection;

said control edges arranged to control one overflow opening in a wall of said pump cylinder, said pump cylinder further being surrounded in the vicinity of said at least one overflow opening by a partial suction chamber;

said partial suction chamber having an inlet conduit arranged to supply fuel thereto and said conduit arranged to extend in a longitudinal direction of said pump housing, each said partial suction chamber having a separate return-flow conduit connected via return-flow openings, wherein each return-flow opening has a flow-through cross section ($A_R$) that is smaller than the cross section of said return-flow conduit, and wherein each of said partial suction chambers is embodied as a hollow space which completely surrounds the pump cylinder and communicates with the return-flow conduit only via the return-flow opening and with said inlet conduit only via a throttled inlet opening.

2. A fuel injection pump as defined by claim 1, further wherein each said throttled inlet opening has a flow-through cross section ($A_Z$) which is smaller than the flowthrough cross section ($A_R$) of said associated return-flow opening.

3. A fuel injection pump as defined by claim 1, further wherein said flowthrough cross section ($A_Z$) of the next inlet opening in succession—as viewed from the direction of the inlet of the inlet conduit—is larger than the flowthrough cross section ($A_Z$) of the preceding flow-through opening.

4. A fuel injection pump as defined by claim 2, further wherein said flowthrough cross section ($A_Z$) of the next inlet opening in succession—as viewed from the direction of the inlet of the inlet conduit—is larger than the flowthrough cross section ($A_Z$) of the preceding flow-through opening.

5. A fuel injection pump as defined by claim 1, further wherein said return-flow conduit is embodied as a bore which extends in the longitudinal direction of the pump housing, and said inlet conduit is embodied by a longitudinal bore, and further that said return-flow openings and inlet openings are embodied as connecting bores which discharge directly into said return-flow and inlet conduits respectively, beginning at said partial suction chambers.

6. A fuel injection pump as defined by claim 5, further wherein said partial suction chambers are defined by a section of said reception bores which bores are machined into the pump housing from the top thereof.

7. A fuel injection pump as defined by claim 5, further wherein said connecting bores which form said return-flow and inlet openings have an oblique position inclined at an acute angle ($\alpha$) relative to said longitudinal axis (LA) of said pump cylinders and relative to said pump top.

8. A fuel injection pump as defined by claim 1, further wherein each of said inlet openings discharge into said partial suction chambers is provided with a check valve arranged to open toward said partial suction chamber.

9. A fuel injection pump as defined by claim 8, further wherein said check valve is embodied as a flutter valve comprising a movable valve member which is embodied by a tongue-like section of a slotted sheath rolled from spring steel, said torque-like segment adapted to rest positively with a slight initial tension, on said inlet opening.

10. A fuel injection pump as defined by claim 9, further wherein said sheath is inserted into said partial suction chamber and said movable valve member rests positively on the wall of said section of said reception bore.

11. A fuel injection pump as defined by claim 9, further wherein said sheath further includes a protrusion bent outwardly therefrom, said protrusion arranged to engage a recess in said wall of said section, to thereby form said partial suction chamber of the reception bore.

12. A fuel injection pump as defined by claim 10, further wherein said sheath further includes a protrusion bent outwardly therefrom, said protrusion arranged to engage a recess in said wall of said section, to thereby form said partial suction chamber of the reception bore.

13. A fuel injection pump as defined by claim 6, further wherein said walls of said return-flow and inlet conduits formed by said longitudinal bores are arranged to intersect with said sections of said reception bores which define said partial suction chambers and thereby form flowthrough openings, and further that a sheet-metal insert which includes in its wall said return-flow opening and said throttled inlet opening is inserted into each of said sections.

14. A fuel injection pump as defined by claim 13, further wherein said sheet-metal insert is embodied by a slotted sheath rolled from sheet steel, the rotational position of said sheath being fixed by a securing element.

15. A fuel injection pump as defined by claim 14, further wherein said sheet-metal insert further includes a securing element in the form of a protrusion which is bent from a surface thereof.

16. A fuel injection pump as defined by claim 14, further wherein said sheet-metal insert snugly engages said wall of said section of said reception bore to thereby define said partial suction chamber.

17. A fuel injection pump as defined by claim 15, further wherein said sheet-metal insert snugly engages said wall of said section of said reception bore to thereby define said partial suction chamber.

18. A fuel injection pump as defined by claim 13, further wherein said sheet-metal insert comprises hardened steel and thereby serves simultaneously as an impact protection ring.

19. A fuel injection pump as defined by claim 13, further wherein said sheet-metal insert is provided with a check valve, preferably including a tongue means arranged to open toward said partial suction chamber, said check valve further arranged to block off a return flow through said inflow opening.

20. A fuel injection pump as defined by claim 14, further wherein said sheet-metal insert is provided with a check valve, preferably including a tongue means arranged to open toward said partial suction chamber, said check valve further arranged to block off a return flow through said inflow opening.

* * * * *